US005119015A

United States Patent [19]

Watanabe

[11] Patent Number: 5,119,015

[45] Date of Patent: Jun. 2, 1992

[54] STABILIZED CONSTANT-VOLTAGE CIRCUIT HAVING IMPEDANCE REDUCTION CIRCUIT

[75] Inventor: Hikaru Watanabe, Nagoya, Japan

[73] Assignee: Toyota Jidosha Kabushiki Kaisha, Toyota, Japan

[21] Appl. No.: 626,541

[22] Filed: Dec. 12, 1990

[30] Foreign Application Priority Data

Dec. 14, 1989 [JP] Japan ..... 1-324386

[51] Int. Cl.[5] ..... G05F 3/16

[52] U.S. Cl. ..... 323/313; 323/314

[58] Field of Search ..... 323/313, 314

[56] References Cited

U.S. PATENT DOCUMENTS

| | | | |
|---|---|---|---|
| 3,887,863 | 6/1975 | Brokaw | 323/314 |
| 3,975,648 | 8/1976 | Tobey et al. | 323/314 |
| 4,068,134 | 1/1978 | Tobey et al. | 323/314 |
| 4,506,208 | 3/1985 | Nagano | 323/314 |
| 4,525,663 | 6/1985 | Henry | 323/313 |
| 4,675,593 | 6/1987 | Minakuchi | 323/314 |
| 4,714,872 | 12/1987 | Traa | 323/315 |
| 4,795,928 | 1/1989 | Menon et al. | 323/907 |
| 4,795,961 | 1/1989 | Neidorff | 323/314 |

*Primary Examiner*—Jeffrey Sterrett

*Attorney, Agent, or Firm*—Cushman, Darby & Cushman

[57] ABSTRACT

A stabilized constant-voltage circuit includes a differential amplifier having a first input terminal, a second input terminal and an output terminal. The differential amplifier amplifies voltage difference between the first and second input terminals, and outputs a stabilized constant voltage via the output terminal. The differential amplifier has a feedback loop coupled between the output terminal and one of the first and second input terminals. The stabilized constant-voltage circuit also includes an impedance reduction circuit which is coupled to a node located in the feedback loop and which reduces an impedance of the node located in the feedback loop.

18 Claims, 4 Drawing Sheets

STABILIZED CONSTANT-VOLTAGE CIRCUIT HAVING IMPEDANCE REDUCTION CIRCUIT

BACKGROUND OF THE INVENTION

1) Field of the Invention

The present invention generally relates to a stabilized constant-voltage circuit, and more particularly to a stabilized constant-voltage circuit having a feedback loop used for stabilizing an output voltage of the stabilized constant-voltage circuit.

2) Description of the Related Arts

In a semiconductor integrated circuit, a constant-voltage circuit having a feedback loop used for stabilizing an output voltage is frequently used as a reference voltage source. For example, U.S. Pat. No. 4,795,918 (which corresponds to Japanese Laid-Open Patent Application No. 64-46812) discloses a bandgap type reference voltage circuit, which is one typical example of a constant-voltage circuit. Such a bandgap type reference voltage circuit is frequently used in a bipolar type integrated circuit as a reference voltage source which depends on temperature very little.

FIG. 1A is a circuit diagram of another bandgap type reference voltage circuit, and FIG. 1B is a circuit diagram equivalent to the circuit shown in FIG. 1A. A differential amplifier or an operational amplifier 10 shown in FIG. 1B is composed of transistors Q3 through Q6 and a resistor R4 shown in FIG. 1A. A current amplifier Ai is composed of transistors Q7 and Q8 and a resistor R5. A constant-current source 11 supplies a constant current necessary to operate the entire circuit. A feedback control is employed so that inverting and non-inverting input terminals of the differential amplifier 10 are approximately equal to each other. A feedback loop extends from the collector of the transistor Q4 to the base thereof via the transistors Q7 and Q8 and the resistor R2. A capacitor C1 functions as a phase compensation capacitor which decreases a feedback voltage gain (loop gain) in a high frequency range and prevents the circuit from oscillating.

It is assumed that currents passing through resistors R1 and R2 are represented by I1 and I2 and a base-emitter voltage of the transistor Q1 is represented by $V_{BE1}$. When the base currents of the transistors Q1 and Q2, an input bias current and an offset current of the differential amplifier 10 are negligible, an output voltage $V_{BG}$ obtained at the collector of the transistor Q8 shown in FIG. 1A is expressed as follows.

$$V_{BG}=V_{BE1}+\{(R2/R3)(kT/q)\}\ln(I1/I2) \quad (1)$$

where k is the Boltzmann constant, T is the absolute temperature and q is a charge of an electron.

The first term on the right side of the equation (1), $V_{BE1}$, has a negative temperature coefficient approximately equal to −2mV°C. On the other hand, from the relationship, I1>I2, the second term on the right side of the equation (1) has a positive temperature coefficient. Thus, by selecting an appropriate value of the resistor R2, it becomes possible to set the temperature coefficient at zero.

As has been described previously, the phase compensation capacitor C1 is employed in order to decrease the loop gain in the high frequency range and prevent the circuit from oscillating. However, in a case where the capacitor C1 is formed of an on-chip capacitor, the chip size becomes large. For this reason, the use of an on-chip capacitor is not effective nor efficient in practical use.

It is conceivable to provide an emitter resistor $R_E$ connected to the emitter of the transistor Q7 in order to decrease the loop gain. However, it is possible to sufficiently decrease the loop gain only when the emitter resistor $R_E$ is equal to or greater than a few tens of kiro-ohms. This leads to an increase in the chip area. Further, when the emitter resistor $R_E$ equal to or greater than a few tens of kiro-ohms is used, the transistor Q4 is saturated because of a voltage drop which develops across the emitter resistor $R_E$, so that the differential amplifier 10 does not operate correctly.

SUMMARY OF THE INVENTION

It is a general object of the present invention to provide an improved stabilized constant voltage circuit in which the above-mentioned disadvantages are eliminated.

A more specific object of the present invention is to provide a stabilized constant voltage circuit capable of stably decreasing the loop gain without causing oscillation and using a reduced size phase compensation capacitance.

The above-mentioned objects of the present invention are achieved by a stabilized constant-voltage circuit which includes a differential amplifier having a first input terminal, a second input terminal and an output terminal. The differential amplifier amplifies a voltage difference between the first and second input terminals, and outputs a stabilized constant voltage via the output terminal. The differential amplifier has a feedback loop coupled between the output terminal and one of the first and second input terminals. The stabilized constant-voltage circuit also includes an impedance reduction circuit which is coupled to a node located in the feedback loop and which reduces an impedance of the node located in the feedback loop.

BRIEF DESCRIPTION OF THE DRAWINGS

Other objects, features and advantages of the present invention will become more apparent from the following detailed description when read in conjunction with the accompanying drawings, in which.

DESCRIPTION OF THE PREFERRED EMBODIMENTS

Figure 1B:
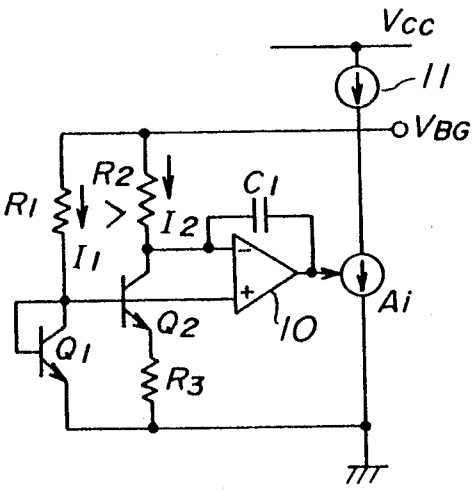
FIGS. 1A and 1B are respectively circuit diagrams illustrating a conventional bandgap type reference voltage circuit.
Figure 1A:
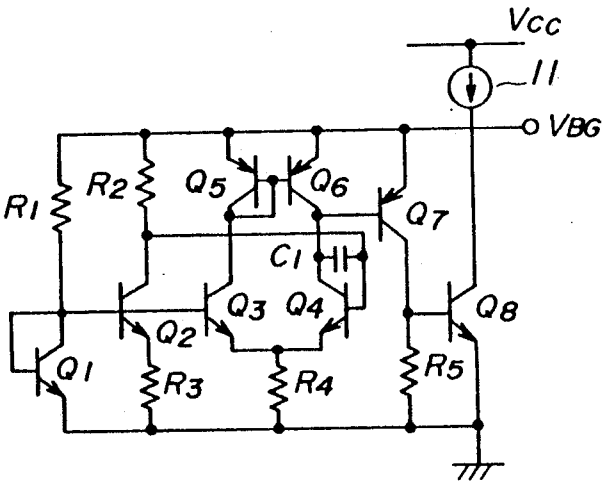

A description will now be given of a stabilized constant voltage circuit according to a first preferred embodiment of the present invention with reference to FIG. 2, in which those parts which are the same as those shown in FIGS. 1A and 1B are given the same reference numerals. A constant current source 21 is composed of a Zener diode Dz, a resistor R10 and a PNP transistor Q10. The constant current source 21 provides a constant current necessary to operate the entire circuit. The base and collector of the transistor Q10 are coupled to each other via the resistor R10. The collector of the transistor Q10 is grounded. The base of the transistor Q10 is coupled to a positive power source (or power supply line) supply line having a positive voltage Vcc.

An output voltage Vout of the stabilized constant-voltage circuit is obtained at an output terminal 22 connected to the emitter of the transistor Q8 with respect to the voltage Vcc.

An impedance reduction circuit 23 is connected between the Vcc power supply line and the emitter of the transistor Q10 of the constant-current source 21. The impedance reduction circuit 23 is composed of resistors R11 and R12 and a diode D10, all of which are connected in series. More specifically, the anode of the diode D10 is connected to the Vcc power supply line, and the cathode thereof is connected to one end of the resistor R12. The other end of the resistor R12 is connected to one end of the resistor R11, and the other end of the resistor R11 is connected to the emitter of the transistor Q10. A connection node at which the resistors R11 and R12 are connected in series is connected to the output terminal 22.

A further description will now be given of the impedance reduction circuit 23. Generally, an impedance reduction circuit has the conceptualization (equivalent circuit) shown in FIG. 3A. As shown, an impedance reduction circuit is formed of a direct-current source V1 having a resistor $R_L$ having a low resistance value. A positive terminal of the direct-current source V1 is connected to a connection node 25, and a negative terminal thereof is grounded. The connection node 25 is at a point which is in a feedback loop and which has a high impedance. As will be described later, the loop gain is proportional to the impedance of the connection node. The voltage V1 is set equal to, for example, a direct-current operating voltage obtained before the impedance reduction circuit 23 is connected to the connection node 25. The impedance reduction circuit functions to decrease the impedance of the connection node 25 to approximately the resistance value $R_L$.

Figure 2:
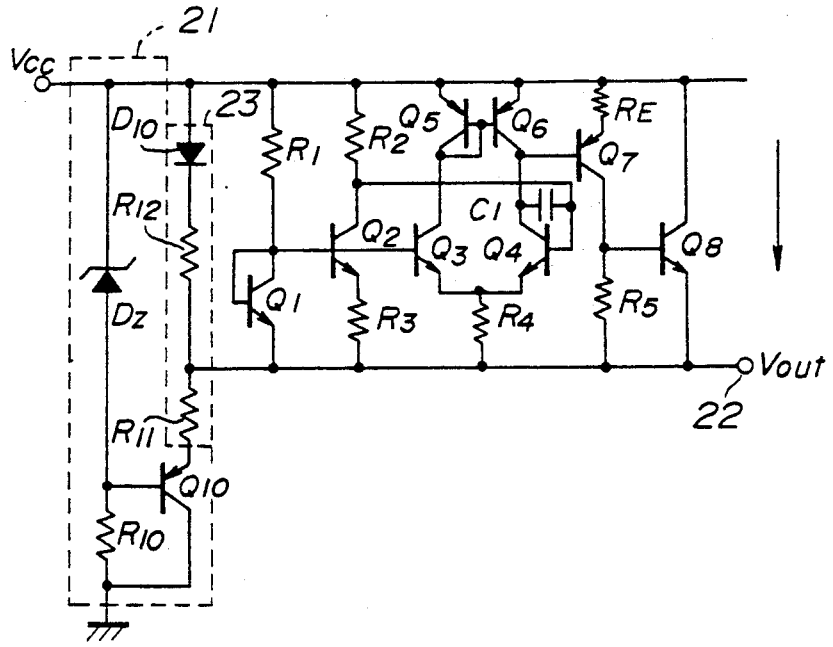
FIG. 2 is a circuit diagram of a stabilized constant-voltage circuit according to a first embodiment of the present invention.
Figure 3A:
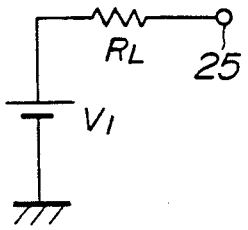
FIG. 3A is an equivalent circuit diagram of an impedance reduction circuit used together with a constant-current source.
Figure 3B:
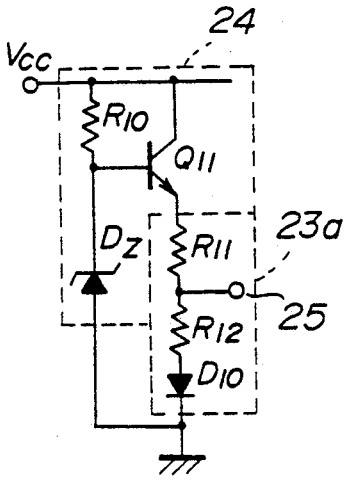
FIG. 3B is a circuit diagram illustrating a first impedance reduction circuit together with a constant-current source.
Figure 3C:
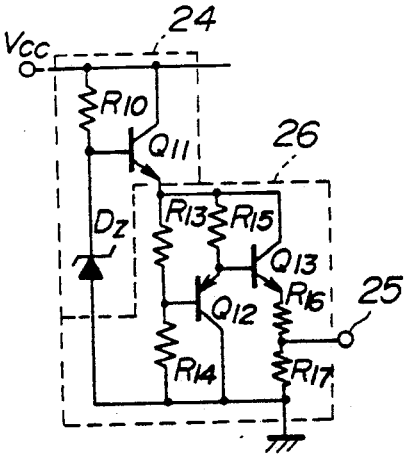
FIG. 3C a circuit diagram illustrating a second impedance reduction circuit together with the constant-current source shown in FIG. 3B.
Figure 3D:
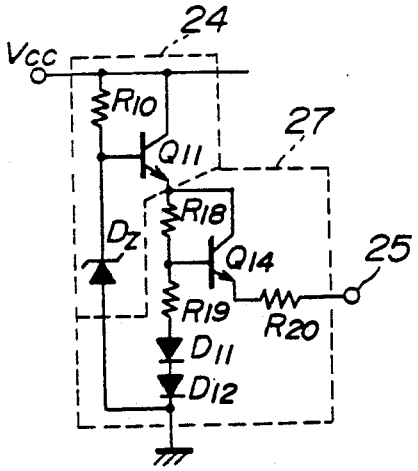
FIG. 3D is a circuit diagram illustrating a third impedance reduction circuit together with the constant-current source shown in FIG. 3B.

Three examples of the impedance reduction circuit having the concept shown in FIG. 3A are respectively illustrated in FIGS. 3B, 3C and 3D, in each of which a constant-current source, such as the constant current source 21 shown in FIG. 2, is also illustrated. It will be noted that the impedance reduction circuit according to the present invention cooperates with the constant-current source. From this point of view, it is possible to consider that the constant-current source includes the impedance decreasing circuit according to the present invention.

FIG. 3B illustrates an impedance reduction circuit 23a which is similar to that shown in FIG. 2, and a constant-current source 24. As shown in FIG. 3B, the constant-current source 24 is composed of an NPN transistor Q11, a resistor R10 and a Zener diode Dz. The anode of the Zener Diode Dz is grounded, and the cathode thereof is connected to the base of the transistor Q11 and the resistor R10. The Vcc power supply line is connected to the collector of the transistor Q11 and the resistor R10. The emitter of the transistor Q11 is connected to the resistor R11 of the impedance reduction circuit 25.

Impedance Z1 of the impedance reduction circuit 23a which is viewed from the connection node 25, is expressed as follows, if the Zener diode Dz has a sufficient constant-voltage characteristic and thus the output impedance thereof is zero:

$$Z1 = 1/[1/(re1 + R11) + 1/(re2 + R12)] \quad (2)$$

where re1 and re2 are the ON resistances of the transistor Q11 and the diode D10, respectively.

The connection node 25 of the impedance reduction circuit 23a is connected to the output terminal 22 shown in FIG. 2. For example, the direct-current operating voltage of the output terminal 22 is constant and approximately equal to 1.2 volts, and the voltage of the connection node 25 defined by the resistor R12 and the diode D10 is approximately equal to 1.2 volts. The diode D10 generates a voltage shift (voltage drop) approximately equal to 0.7 volts. This voltage shift functions to decrease a current passing through the resistor R12, so that reduced power consumption can be obtained.

It will be noted that a Zener voltage Vz of the Zener diode Dz has a positive temperature characteristic, and the base-emitter voltage of the transistor Q1l and a forward voltage VF of the diode D10 have negative temperature characteristics. Further, a diffusion resistance formed in a semiconductor substrate has a positive temperature characteristic which provides the absolute value of temperature which increases as the impurity density decreases. In the circuit shown in FIG. 3B, the temperature characteristic of the diode D10 greatly affects the output voltage. From this point of view, the resistor R12 is formed of a diffusion resistor having an impurity density less than that of a diffusion resistor forming the resistor R11, so that the temperature coefficient of the entire circuit approaches zero.

FIG. 3C shows an impedance reduction circuit 26, which is composed of resistors R13 through R17, and transistors Q12 and Q13. The impedance reduction circuit 26 has a first emitter follower circuit and a second emitter follower circuit. The first emitter follower circuit is composed of the transistor Q12 and the resistor R15, and the second emitter follower circuit is composed of the transistor Q13 and the resistors R16 and R17. The first emitter follower circuit is connected to a connection node where the resistors R13 and R14 are connected in series. A connection node where the resistors R16 and R17 are connected in series is connected to the connection node 25 at which it is required to decrease the impedance. The impedance of the impedance reduction circuit 26 viewed from the connection node 25 is small due to the existence of the two emitter follower circuits. It is possible to set the temperature coefficient approximately equal to zero by adjusting the elements shown in FIG. 3C so that the temperature coefficients of the elements are mutually canceled.

FIG. 3D shows an impedance reduction circuit 27, which is composed of resistors R18 through R20, an NPN transistor Q14, and two diodes D11 and D12 connected in series. An emitter follower circuit is formed by the transistor Q14 and the resistor R20. The base of the transistor Q14 is connected to a connection node at which the resistors R18 and R19 are connected in series. The collector of the transistor Q14 is connected to the emitter of the transistor Q11 of the constant-current source 24. The emitter of the transistor Q14 is coupled to the connection node 25 via the resistor R20. The base of the transistor Q14 is also coupled to the anode of the diode D11 via the resistor R19. The cathode of the diode D12 is grounded and connected to the anode of the Zener diode Dz. The emitter follower circuit functions to decrease the impedance viewed from the connection node 25.

The diodes D11 and D12 are used for the temperature compensation, and function to set the temperature coefficient of the impedance reduction circuit 27 to be zero. If the diodes D11 and D12 are not provided, the temperature coefficient of the impedance reduction circuit 27 will be equal to +3 to 4 mV/°C.

A loop gain Avl1 of the constant-voltage circuit having the impedance reduction circuit according to the present invention shown in FIG. 2 is described as follows when the circuit operates at high frequencies:

$$Avl1=(\alpha/\omega R2Cl)\ gm\ \text{Rnode} \quad (3)$$

where $\alpha$ is an attenuation ratio based on the transistors Q1 and Q2 and the resistors R1–R3, gm is the mutual conductance of the current amplifier including the transistors Q7 and Q8, Rnode is the impedance of the output terminal 22, and $\omega$ is the angular frequency. It will be noted that the formula (3) holds true for the conventional circuit shown in FIGS. 1A and 1B.

According to the present invention, the impedance Rnode of the output terminal 22 is sufficiently reduced due to the function of the impedance reduction circuit 23 connected to the output terminal 22 which is in the feedback loop. It will be noted that the loop gain Avl1 is proportional to the impedance of the output terminal 22. With the above-mentioned arrangement, it is possible to obtain the loop gain Avl1 equal to or less than a quarter of the loop gain obtained by the conventional circuit shown in FIGS. 1A and 1B. It should also be noted that the impedance reduction circuit 23 is composed of only three elements, that is, the two resistors R11 and R12 and the diode D10. Thus, an increase in the chip area caused by providing these three elements is negligible. Further, it is enough to slightly change the mask pattern used during the production process to obtain the circuit arrangement shown in FIG. 2. Moreover, by decreasing the impedance of the output terminal 22, it is possible to not only reduce the loop gain but also increase a frequency fp of a pole defined by the following formula:

$$fp=1(2\pi\cdot\text{Rnode}\cdot\text{Cnode})$$

where Cnode denotes a parasitic capacitance coupled to the output terminal 22. A decrease in the frequency of the pole decreases a phase delay, and thus improves stability of the circuit operation.

A description will now be given of a stabilized constant-voltage circuit according to a second preferred embodiment of the present invention with reference to FIG. 4, in which those parts which are the same as those shown in the previous figures are given the same reference numerals. The circuit shown in FIG. 4 has the constant-current source 24 and the impedance reduction circuit 27 shown in FIG. 3D. An output voltage Vout corresponds to a potential difference between the grounded emitter of the transistor Q8 and an output terminal 29 connected to the emitters of the transistors Q5 and Q6. The connection node 25 shown in FIG. 3D is connected to the collector of the transistor Q8 and to a base of an NPN transistor Q15. The collector of the transistor Q15 is connected to the emitter of the transistor Q11 of the constant-current source 24. The emitter of the transistor Q15 is connected to the output terminal 29. A feedback loop extends from the collector of the transistor Q4 to the base thereof via the transistors Q7, Q8 and Q15 and the resistor R2. The impedance reduction circuit 27 reduces the loop gain and the chip area necessary to form the phase compensation capacitor Cl. Further, the circuit shown in FIG. 4 can be fabricated by slightly modifying the mask pattern and operates in the stable state.

Figure 5:
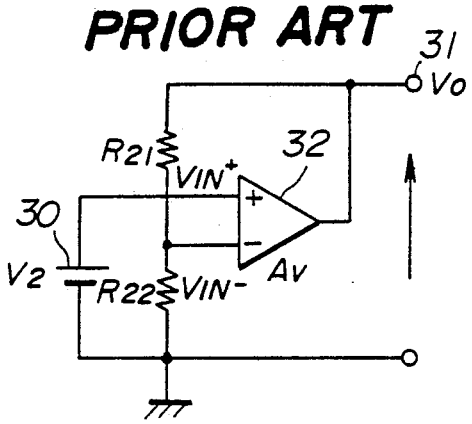
FIG. 5 PRIOR ART
FIG. 5 is a circuit diagram of a conventional constant-voltage circuit.

Referring to FIG. 5, there is illustrated a conventional constant-voltage circuit, which is composed of a differential amplifier 32, resistors R21 and R22 and a direct-current voltage source 30. An output voltage V0 obtained at an output terminal 31 and defined by the following formula is generated from a reference voltage V2 output by the direct-current voltage source 30.

$$V0=V2(R21+R22)/R22 \quad (4)$$

A differential amplifier 32 is subjected to a feedback control in which an inverting input terminal voltage $V_{IN}+$ and a non-inverting input terminal voltage $V_{IN}-$ are equal to each other, that is, the reference voltage V2. However, it will be noted that an input bias current and an input offset voltage of the differential amplifier 32 are sufficiently small. Assuming that a voltage amplification is represented by Av, a loop gain Avl2 of the circuit shown in FIG. 5 is expressed as follows.

$$Avl2=\{(1/R21)/[(1/R21)+(1/R22)]\}[Av \quad (5)$$

Figure 4:
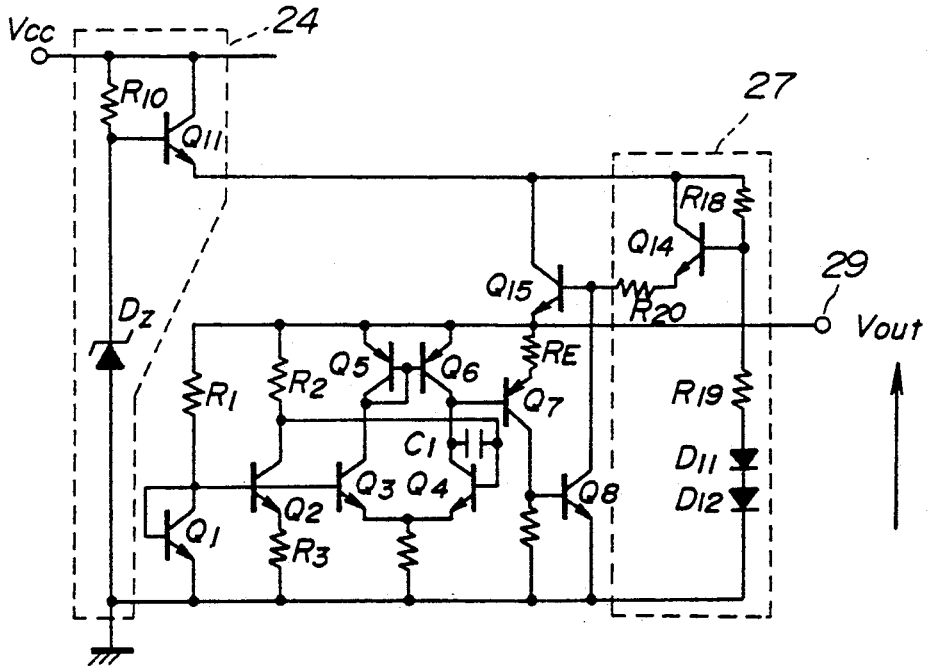
FIG. 4 is a circuit diagram of a stabilized constant-voltage circuit according to a second embodiment of the present invention.

Generally, a phase compensation capacitor is built in the differential amplifier 32 in the same way as the phase compensation capacitor C1 shown in FIG. 4. However, the circuit frequently oscillates.

Figure 6:
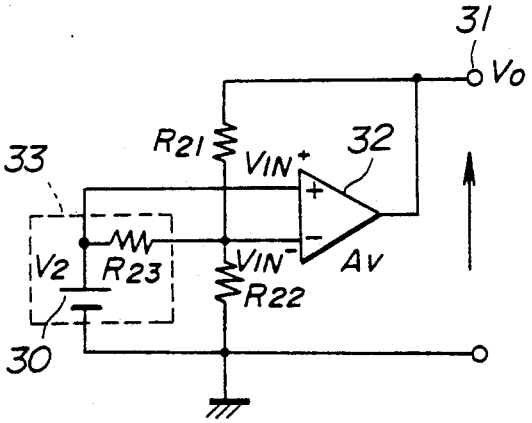
FIG. 6 is a circuit diagram of a stabilized constant-voltage circuit according to a third embodiment of the present invention directed to an improvement in the circuit shown in FIG. 5.

Referring to FIG. 6, there is illustrated a stabilized constant-voltage circuit according to a third preferred embodiment of the present invention. In FIG. 6, those parts which are the same as those shown in FIG. 5 are given the same reference numerals. The circuit shown in FIG. 6 corresponds to an improvement in the circuit shown in FIG. 5. An impedance reduction circuit 33 composed of a direct-current voltage source 30 and a resistor R23 is connected to the inverting input terminal of the differential amplifier 32 which is in a feedback loop including the resistor R21. A connection node at which the direct-current voltage source 30 and the resistor R23 are connected in series is connected to the non-inverting terminal of the differential amplifier 32.

The differential amplifier 32 is subjected to the feedback control so that the non-inverting input terminal potential $V_{IN}+$ and the inverting input terminal potential $V_{IN}-$ are equal to each other, that is, the reference voltage V2. The output voltage Vo obtained at the output terminal 31 and ground is defined by the aforementioned formula (5). Since the differential amplifier 32 is controlled so that the non-inverting input terminal $V_{IN}-$ becomes equal to the reference voltage V2, no current passes through the resistor R23. It should be noted that the impedance reduction circuit 33 is very simple because it can be obtained by adding the resistor R23 to the circuit shown in FIG. 5.

A loop gain Avl3 of the circuit shown in FIG. 6 is written as follows.

$$Avl3=\{(1/R21)/[(1/R21)+(1/R22)+(1/R23)]\}Av \quad (6)$$

It should be noted that the loop gain Avl3 is less than the loop gain Avl2 of the circuit shown in FIG. 5. Thus, the circuit shown in FIG. 6 is more difficult to oscillate than the circuit shown in FIG. 5. In addition, it is possible to further reduce capacitance of the phase compensation capacitor built in the differential amplifier 32.

Figure 7:
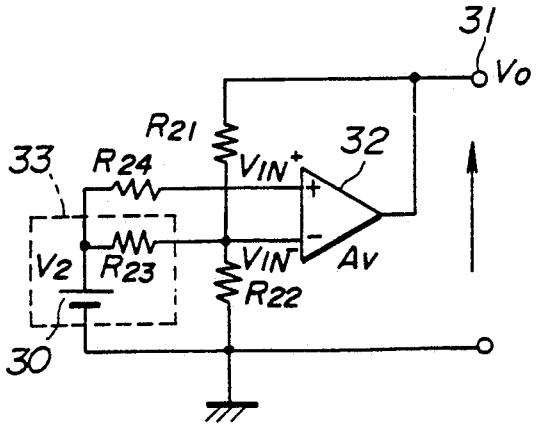
FIG. 7 is a circuit diagram of a variation of the stabilized constant-voltage circuit shown in FIG. 6.

In a case where it is not possible to neglect an input bias current of the differential amplifier 32, it is preferable to add a resistor R24, as shown in FIG. 7. The resistor R24 is connected between the positive terminal of the direct-current voltage source.

What is claimed is:

1. an amplifier having a first input terminal, a second input terminal and an output terminal, said amplifier amplifying a voltage difference between said first and second input terminals and outputting a stabilized constant voltage via said output terminal;

a feedback loop coupled between said output terminal and one of said first and second input terminals; and impedance reduction means, coupled to a node of said feedback loop, for reducing an impedance of said node, said impedance reduction means having an equivalent circuit having a constant-current source of a voltage substantially equal to a voltage obtained at said node before said impedance reduction means is connected thereto and an impedance element having an impedance less than that obtained at said node before said impedance reduction means is connected thereto.

2. A stabilized constant-voltage circuit as claimed in claim 1, wherein said node located in said feedback loop is a node at which a gain of said feedback loop is approximately proportional to the impedance of said node.

3. A stabilized constant-voltage circuit as claimed in claim 1, wherein said node is the output terminal of said amplifier.

4. A stabilized constant-voltage circuit as claimed in claim 1, further comprising constant-current source means for controlling a sum of a current passing through said amplifier and a current passing through said impedance reduction means so that said sum is constant.

5. A stabilized constant-voltage circuit as claimed in claim 1, wherein said impedance reduction means has a first terminal and a second terminal, a voltage being applied therebetween, and wherein said impedance reduction means comprises:

a first resistor;

a second resistor connected to said first resistor in series at said node located in said feedback loop; and a diode connected in series to one of said first and second resistors.

6. A stabilized constant-voltage circuit as claimed in claim 5, further comprising:

a constant-current source transistor having an emitter, a collector receiving a first power source voltage, and a base, said first terminal of said impedance reduction means being connected to the emitter, said second terminal of said impedance reduction means receiving a second power source voltage;

a resistor coupled between the base and collector of the constant-current source transistor; and a Zener diode coupled between the base of said constant-current source transistor and said second terminal of said impedance reduction means.

7. A stabilized constant-voltage circuit as claimed in claim 5, further comprising:

a constant-current source transistor having an emitter, a collector and a base, said first terminal of said impedance reduction means being connected between the emitter, said second terminal of said impedance reduction means receiving a first power source voltage, and said collector receiving a second power source voltage;

a resistor coupled between the collector and the base of said constant-current source transistor; and a Zener diode coupled between the base of said constant-current source transistor and said second terminal of said impedance reduction means.

8. A stabilized constant-voltage circuit as claimed in claim 5, wherein:

said first resistor comprises a diffusion resistor;

said second resistor comprises a diffusion resistor; and an impurity density of said first resistor is different from that of said second resistor so that a temperature coefficient of said stabilized constant-voltage circuit becomes approximately zero.

9. A stabilized constant-voltage circuit as claimed in claim 1, wherein said impedance reduction means has a first terminal and a second terminal, a voltage being applied between said first terminal and said second terminal, and wherein said impedance reduction mean comprises:

a first transistor coupled between said first and second terminals of said impedance reduction means;

a second transistor coupled between said first and second terminals of said impedance reduction means, said second transistor having a base coupled to an emitter of said first transistor; and a series circuit coupled between the emitter of said second transistor and said second terminal of said impedance reduction means and composed of first and second resistors connected in series at said node located in said feedback loop.

10. A stabilized constant-voltage circuit as claimed in claim 9, further comprising:

a constant-current source transistor having an emitter, a collector receiving a first power source voltage, and a base, said first terminal of said impedance reduction means being connected to the emitter of said constant-current source transistor, said second terminal of said impedance reduction means receiving a second power source voltage;

a resistor coupled between the collector and the base of said constant-current source transistor; and a Zener diode coupled between the base of said constant-current source transistor and said second terminal of said impedance reduction means.

11. A stabilized constant-voltage circuit as claimed in claim 1, wherein said impedance reduction means has a first terminal and a second terminal, a voltage being applied between said first terminal and said second terminal, and wherein said impedance reduction means comprises:

a transistor having a collector connected to the first terminal of said impedance reduction means, an emitter and a base;

a first resistor coupled between the emitter of said transistor and said node located in said feedback loop;

a second resistor coupled between the collector and base of said transistor; and a series circuit coupled between the base of said transistor and said second terminal of said impedance reduction means and composed of a diode circuit and a third resistor connected in series.

12. A stabilized constant-voltage circuit as claimed in claim 11, wherein said diode circuit comprises first and second diodes connected in series.

13. A stabilized constant-voltage circuit as claimed in claim 11, further comprising:

a constant-current source transistor having an emitter, a collector receiving a first power source voltage, and a base, said first terminal of said impedance reduction means being connected to the emitter of said constant-current source transistor, said second terminal of said impedance reduction means receiving a second power source voltage;

a resistor coupled between the collector and the base of said constant-current source transistor; and a Zener diode coupled between the base of said constant-current source transistor and said second terminal of said impedance reduction means.

14. A stabilized constant-voltage circuit as claimed in claim 1, wherein said impedance reduction means comprises:

a direct-current voltage source having a positive terminal directly connected to one of said first and second input terminals other than said one of said first and second input terminals to which said feedback loop is connected, and a negative terminal; and a resistor coupled between said positive terminal of the direct-current voltage source and said one of the first and second input terminals to which said feedback loop is connected.

15. A stabilized constant-voltage circuit as claimed in claim 1, wherein said impedance reduction means comprises:

a direct-current voltage source having a positive terminal and a negative terminal;

a first resistor coupled between said positive terminal of the direct-current voltage source and one of the first and second input terminals other than said one of the first and second input terminals to which said feedback loop is connected; and a second resistor coupled between said positive terminal of said direct-current voltage source and the other one of the first and second input terminals.

16. A stabilized constant-voltage circuit as claimed in claim 1, wherein said amplifier comprises an operational amplifier.

17. A stabilized constant-voltage circuit as claimed in claim 1, further comprising current amplifier means, coupled to the output terminal of said amplifier, for amplifying a current passing through the output terminal of said amplifier.

18. A stabilized constant-voltage circuit as claimed in claim 1, wherein said feedback loop comprises a resistor.

* * * * *